US010943717B2

(12) United States Patent
Miwa et al.

(10) Patent No.: US 10,943,717 B2
(45) **Date of Patent: *Mar. 9, 2021**

(54) R-T-B BASED PERMANENT MAGNET

(71) Applicant: TDK CORPORATION, Tokyo (JP)

(72) Inventors: Masashi Miwa, Tokyo (JP); Takurou Iwasa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 146 days.

This patent is subject to a terminal disclaimer.

(21) Appl. No.: 15/440,755

(22) Filed: Feb. 23, 2017

(65) Prior Publication Data

US 2017/0250016 A1 Aug. 31, 2017

(30) Foreign Application Priority Data

Feb. 26, 2016 (JP) ..... JP2016-035103

(51) Int. Cl.
*H01F 1/057* (2006.01)
*B22F 9/04* (2006.01)
(Continued)

(52) U.S. Cl.
CPC ..... *H01F 1/0577* (2013.01); *B22D 11/001* (2013.01); *B22F 3/16* (2013.01); *B22F 5/00* (2013.01); *B22F 9/04* (2013.01); *C21D 3/06* (2013.01); *C22C 33/0278* (2013.01); *C22C 38/001* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01);
(Continued)

(58) Field of Classification Search
None
See application file for complete search history.

(56) References Cited

U.S. PATENT DOCUMENTS

2011/0025440 A1 2/2011 Kuniyoshi et al.
2014/0105779 A1* 4/2014 Nakamura ..... H01F 1/0572 419/31

(Continued)

FOREIGN PATENT DOCUMENTS

JP 2006-295140 A 10/2006
JP 2013-216965 A 10/2013

(Continued)

*Primary Examiner* — Xiaowei Su
(74) *Attorney, Agent, or Firm* — Oliff PLC

(57) ABSTRACT

An R-T-B based permanent magnet includes main phase grains composed of $R_2T_{14}B$ type compound. R is a rare earth element. T is iron group element(s) essentially including Fe or Fe and Co. B is boron. An average grain size of the main phase grains is 0.8 μm or more and 2.8 μm or less. The R-T-B based permanent magnet contains at least C and Zr in addition to R, T, and B. B is contained at 0.75 mass % or more and 0.88 mass % or less. Zr is contained at 0.65 mass % or more and 5.00 mass % or less. A formula (1) of $5.0 \leq [B]+[C]-[Zr] \leq 5.6$ is satisfied, where [B] is a B content represented by atom %, [C] is a C content represented by atom %, and [Zr] is a Zr content represented by atom %.

11 Claims, 2 Drawing Sheets

(51) Int. Cl.

| | |
|---|---|
| ***B22F 3/16*** | (2006.01) |
| ***C22C 33/02*** | (2006.01) |
| ***B22D 11/00*** | (2006.01) |
| ***B22F 5/00*** | (2006.01) |
| ***C21D 3/06*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| *H01F 1/058* | (2006.01) |

(52) U.S. Cl.

CPC ... *B22F 2009/042* (2013.01); *B22F 2009/044* (2013.01); *B22F 2201/11* (2013.01); *B22F 2201/20* (2013.01); *B22F 2301/355* (2013.01); *B22F 2998/10* (2013.01); *C22C 2202/02* (2013.01); *H01F 1/058* (2013.01)

(56) References Cited

U.S. PATENT DOCUMENTS

| | | | | |
|---|---|---|---|---|
| 2014/0132377 | A1* | 5/2014 | Nakajima | B22F 3/24 335/302 |
| 2015/0170810 | A1* | 6/2015 | Miwa | C22C 38/001 75/246 |
| 2016/0027564 | A1* | 1/2016 | Une | B22F 1/0044 419/30 |
| 2016/0042847 | A1 | 2/2016 | Nishiuchi et al. | |
| 2016/0163434 | A1 | 6/2016 | Kanada et al. | |
| 2017/0025207 | A1 | 1/2017 | Nakajima et al. | |
| 2017/0250013 | A1* | 8/2017 | Ishiyama | B22F 3/16 |
| 2017/0250015 | A1* | 8/2017 | Miwa | C22C 33/04 |

FOREIGN PATENT DOCUMENTS

| | | | | |
|---|---|---|---|---|
| WO | 2009/122709 | A1 | 10/2009 | |
| WO | WO-2013191276 | A1 * | 12/2013 | C22C 38/001 |
| WO | 2014/157448 | A1 | 10/2014 | |
| WO | 2015/020181 | A1 | 2/2015 | |

* cited by examiner

R-T-B BASED PERMANENT MAGNET

BACKGROUND OF THE INVENTION

1. Field of the Invention

The present invention relates to an R-T-B based permanent magnet whose main components are a rare earth element (R), at least one or more kinds of iron element essentially including Fe or Fe and Co (T), and boron (B).

2. Description of the Related Art

R-T-B based permanent magnets have excellent magnetic properties and are thus used for home electric appliances, various kinds of motors such as voice coil motors (VCM) of hard disk drive and motors mounted on hybrid cars, and the like. When the R-T-B based permanent magnet is used for the motor or so, it is required to be excellent in heat resistance for responding to a use environment of high temperature and further have a high coercivity.

As a method for improving coercivity (HcJ) of the R-T-B based permanent magnet, the rare earth element R to which a light rare earth element of Nd, Pr etc. is mainly applied is partially substituted with a heavy rare earth element of Dy, Tb etc. in order to improve crystal magnetic anisotropy of $R_2T_{14}B$ phases. It tends to be hard to manufacture a magnet having coercivity large enough to be used for the motors without using the heavy rare earth element.

Dy and Tb, however, are more rare in yield and more expensive than Nd and Pr. In recent years, supply instability of Dy and Tb has been worsening due to rapidly expanding demand in R-T-B based permanent magnets of high coercivity type using a large amount of Dy and Tb. It is thus required to obtain coercivity needed for application to the motors or so even in case of a composition containing Dy and Tb as little as possible.

Under such circumstances, research and development for improving coercivity of R-T-B based permanent magnets without using Dy or Tb have been actively conducted. In the research and development, it is reported that coercivity is improved by a composition using less amount of B than an ordinary R-T-B based permanent magnet.

For example, Patent Document 1 reports that an R-T-B based rare earth sintered magnet using less amount of Dy and having a high coercivity is obtained by having a concentration of B lower than an ordinary R-T-B based alloy and containing one or more kinds of metal element "M" selected from Al, Ga, and Cu so as to generate an $R_2T_{17}$ phase, and by sufficiently securing a volume ratio of a transition metal rich phase ($R_6T_{13}M$) generated by using the $R_2T_{17}$ phase as raw material.

Patent Document 2 reports that an R-T-B sintered magnet having a high Br and a high HcJ is obtained without using Dy by having a composition whose amount of R, amount of B, and amount of Ga are within specific ranges to form a thick two-grain boundary.

However, the R-T-B based permanent magnet obtained without using Dy or Tb by these techniques still have an insufficient coercivity as magnets used for the motors under high temperature environment.

Meanwhile, it is generally known that coercivity can be increased by miniaturizing main phase grains in the R-T-B based permanent magnet. For example, Patent Document 3 discloses a technique for improving coercivity of the R-T-B based sintered magnet by configuring a crystal grain size of main phases in the R-T-B based sintered magnet to a circle equivalent diameter of 8 μm or less and by configuring an area ratio occupied by crystal grains of 4 μm or less to 80% or more of the entire main phases. In the R-T-B based permanent magnet containing miniaturized main phase grains, however, a sufficient coercivity for using in high temperature environment still cannot be obtained in case of a composition failing to use Dy or Tb. Also, Patent Document 3 discloses a low sintering temperature of 1000° C. or lower so that a fine powder whose D50 is 3 μm or less is sintered without generating abnormal grain growth, and thus has a problem of requiring a longtime sintering and decreasing productivity.

Adding a predetermined amount of Zr is known as a method for preventing abnormal grain growth during sintering. For example, Patent Document 4 shows that it is possible to prevent abnormal grain growth during sintering and achieve favorable magnetic properties and a wide sintering temperature range by adding Zr of 0.03 wt % to 0.25 wt % to a composition having an extremely low amount of oxygen and containing R, Co, B, Cu, Al, and Ga. Patent Document 4, however, discloses that a finely pulverized powder described in Examples has an average particle size of 4 μm and has a problem that abnormal grain growth during sintering cannot be sufficiently prevented in case of further reducing a particle size of the finely pulverized powder.

Patent Document 1: JP 2013-216965 A
Patent Document 2: WO 2014/157448
Patent Document 3: WO 2009/122709
Patent Document 4: JP 2006-295140 A

SUMMARY OF THE INVENTION

The present inventors conceived that a further improvement of coercivity can be expected if the above-mentioned requirements are combined and the main phase grains of the R-T-B based permanent magnet can be miniaturized with a composition having a reduced amount of B, and then studied. The following problems, however, have become clear only if those techniques are simply combined.

For miniaturization of the crystal grains in the R-T-B based permanent magnet, a particle size of a finely pulverized powder used as raw material needs to be reduced. When the particle size of the finely pulverized powder is miniaturized, however, abnormal grain growth during sintering tends to easily occur as mentioned above. If the abnormal grain growth occurs, a squareness ratio decreases and furthermore coercivity decreases largely. Thus, the sintering temperature needs to be low for prevention of the abnormal grain growth. It was found out, however, that if the sintering temperature is low with a composition of a reduced B concentration, soft magnetic Fe grains become easy to remain in the permanent magnet, and coercivity and squareness ratio cannot be obtained sufficiently. Thus, when the particle size of the finely pulverized powder was reduced with a composition of a reduced B concentration, a sufficient coercivity could not be obtained due to the remaining of Fe grains under a condition of a low sintering temperature, and a sufficient coercivity could not be obtained due to the abnormal grain growth under a condition of a high sintering temperature. An R-T-B based permanent magnet having a sufficient coercivity could not be obtained under either condition.

It is conceivable to significantly increase an additive amount of Zr, which is known as an element having prevention effect of abnormal grain growth, as a means of performing sintering without causing abnormal grain growth using a finely pulverized powder of a fine particle size. When an additive amount of Zr is simply increased, however, there is a problem that coercivity decreases significantly and an R-T-B based permanent magnet having a sufficient coercivity cannot be obtained, even though the abnormal grain growth during sintering can be prevented.

The present invention has been achieved under the above circumstances. It is an object of the invention to provide an R-T-B based permanent magnet capable of obtaining a high coercivity even if a use amount of a heavy rare earth element is reduced.

To overcome the above problems and achieve the object, the present inventors have studied according to the following bases:

(1) It is aimed to improve coercivity by miniaturizing main phase grains of an R-T-B based permanent magnet until a grain size becomes 2.8 μm or less with a composition of a reduced B content, specifically with a composition where B is contained at 0.75 mass % to 0.88 mass %; and (2) A particle size of a finely pulverized powder is reduced so that the main phase grains have an average grain size of 2.8 μm or less, and an abnormal grain growth during sintering is prevented by increasing a Zr content more than before to 0.65 mass % or more.

Under the bases, decrease in coercivity in accordance with increase in a Zr content is a problem. Thus, the present inventors have earnestly studied how to prevent decrease in coercivity occurring in case of a large content of Zr with a composition of a reduced B content. As a result, the present inventors have found out that in this composition, a value of coercivity varies sensitively due to an amount of carbon contained in the R-T-B based permanent magnet, and a high coercivity can be obtained only at the time of a specific composition balance. Then, the present invention has been achieved.

The R-T-B based permanent magnet of the present invention is an R-T-B based permanent magnet including main phase grains composed of $R_2T_{14}B$ type compound, wherein R is a rare earth element, T is iron group element(s) essentially comprising Fe or Fe and Co, and B is boron, an average grain size of the main phase grains is 0.8 μm or more and 2.8 μm or less, the R-T-B based permanent magnet contains at least C and Zr in addition to R, T, and B, B is contained at 0.75 mass % or more and 0.88 mass % or less, Zr is contained at 0.65 mass % or more and 5.00 mass % or less, and a formula (1) of $5.0 \leq [B]+[C]-[Zr] \leq 5.6$ is satisfied, where [B] is a content of B represented by atom %, [C] is a content of C represented by atom %, and [Zr] is a content of Zr represented by atom %.

The R-T-B based permanent magnet of the present invention makes it possible to obtain a high coercivity even with a composition of reduced contents of Dy and Tb due to combination between an improvement in coercivity by a composition of a reduced B content and an improvement in coercivity by miniaturization of the main phase grains. The present inventors conceive as below the reason why in a specific composition region where a B content is small and a Zr content is large, a value of coercivity varies sensitively due to an amount of carbon contained in the R-T-B based permanent magnet, and a high coercivity can be obtained only at the time of a specific composition balance.

(1) When a raw material having a composition where an amount of B is less than that of stoichiometric composition is used as a starting raw material, the amount of B for forming an $R_2T_{14}B$ type compound constituting the main phase grains is lacked. To make up for the shortage amount of B, C existing in the permanent magnet as an impurity is solid soluted into a B site of the $R_2T_{14}B$ type compound of the main phase grains, and the $R_2T_{14}B$ type compound represented by a composition formula of $R_2T_{14}B_xC_{(1-x)}$ is formed.

(2) When the permanent magnet is manufactured, a grain boundary phase changes to a liquid phase at the time of an aging treatment at around 500°. In this step, an outermost surface portion of the main phase grains is partially dissolved and incorporated into the liquid phase. When the aging treatment is finished and the liquid phase changes to the solid phase once again by being cooled, the $R_2T_{14}B$ type compound is deposited once again on the surface of the main phase grains at the same time as the grain boundary phase of the solid phase is formed. The compound on the outermost surface of the main phase grains dissolved by the aging treatment is the compound represented by the composition formula of $R_2T_{14}B_xC_{(1-x)}$, but C is hard to be solid soluted in the $R_2T_{14}B$ type compound in the temperature region of around 500° C., and the compound represented by the composition formula of $R_2T_{14}B$ is deposited on the outermost surface of the main phase grains when the liquid phase changes to the solid phase once again by being cooled. That is, a ratio of the main phase grains decreases and a ratio of the grain boundary phases increases by an amount of the $R_2T_{14}C$ contained in the $R_2T_{14}B_xC_{(1-x)}$ of the outermost surface portion of the main phase grains dissolved by the aging treatment. According to such a mechanism, a thick two-grain boundary is formed by the aging treatment at around 500° C. Forming the thick two-grain boundary magnetically separates the main phase grains and expresses a high coercivity.

(3) When a Zr amount is increased with a composition of a small B amount, Zr tends to be combined with C and form a ZrC compound as Zr is an element having an extremely low generation free energy of a carbide. Thus, a C amount tends to run short if a Zr amount is increased, and a soft magnetic compound such as $R_2T_{17}$ type compound becomes easy to occur by the shortage amount of C instead of the $R_2T_{14}B$ type compound of the main phase. Since coercivity tends to decrease rapidly if an amount of a soft magnetic compound increases, a sufficient coercivity cannot be obtained with a composition where a value of [B]+[C]−[Zr] is less than 5.0.

(4) A high coercivity expresses under the above-mentioned mechanism of (1) and (2) with a composition of a small B amount and a large Zr amount if a C amount is increased to obtain a composition range where a value of [B]+[C]−[Zr] is 5.0 or more and 5.6 or less.

(5) When an amount of C is further increased to obtain a composition where a value of [B]+[C]−[Zr] becomes more than 5.6, there exists a significantly excessive amount of C against a shortage amount of B in the main phase grains, and an amount of C contained in the grain boundary phase increases. When the grain boundary phase changes to the liquid phase by the aging treatment at around 500° C., an amount of C dissolvable in the liquid phase has an upper limit, and thus the $R_2T_{14}B_xC_{(1-x)}$ type compound of the outermost surface portion of the main phase grains cannot be dissolved by an increased amount of C in the grain boundary phase. Thus, the thick two-grain boundary cannot be formed by the aging treatment, a magnetic separation among the main phase grains is weaken, and coercivity is decreased.

Furthermore, in the present invention, a formula (2) of $5.2 \leq [B]+[C]-[Zr] \leq 5.4$ may be satisfied, where [B] is a B content represented by atom %, [C] is a C content represented by atom %, and [Zr] is a Zr content represented by atom %.

With a composition within such a range, it tends to become easier to obtain a higher coercivity.

In the R-T-B based permanent magnet according to the present invention, R may be contained at 25 mass % or more and 36 mass % or less.

In the R-T-B based permanent magnet according to the present invention, Co may be contained at 0.3 mass % or more and 4.0 mass % or less.

In the R-T-B based permanent magnet according to the present invention, C may be contained at 0.1 mass % or more and 0.3 mass % or less.

The R-T-B based permanent magnet according to the present invention may further include Ga, and Ga may be contained at 0.2 mass % or more and 1.5 mass % or less.

The R-T-B based permanent magnet according to the present invention may further include Cu, and Cu may be contained at 0.05 mass % or more and 1.5 mass % or less.

The R-T-B based permanent magnet according to the present invention may further include Al, and Al may be contained at 0.03 mass % or more and 0.6 mass % or less.

The R-T-B based permanent magnet according to the present invention may further include O, and O may be contained at 0.05 mass % or more and 0.5 mass % or less.

The R-T-B based permanent magnet according to the present invention may further include N, and N may be contained at 0.01 mass % or more and 0.2 mass % or less.

In the R-T-B based permanent magnet according to the present invention, a heavy rare earth element may be contained at 1 mass % or less (including zero mass %).

In the R-T-B based permanent magnet according to the present invention, B may be contained at 0.78 mass % or more and 0.84 mass % or less.

In the R-T-B based permanent magnet according to the present invention, Zr may be contained at 0.65 mass % or more and 2.50 mass % or less.

The present invention makes it possible to provide the R-T-B based permanent magnet capable of obtaining a high coercivity even if a use amount of a heavy rare earth element is reduced.

DESCRIPTION OF THE PREFERRED EMBODIMENTS

Hereinafter, the present invention will be described based on embodiments shown in the figures.

First Embodiment

The first embodiment of the present invention is directed to an R-T-B based sintered magnet that is a kind of R-T-B based permanent magnets.

<R-T-B Based Sintered Magnet>

Figure 1:
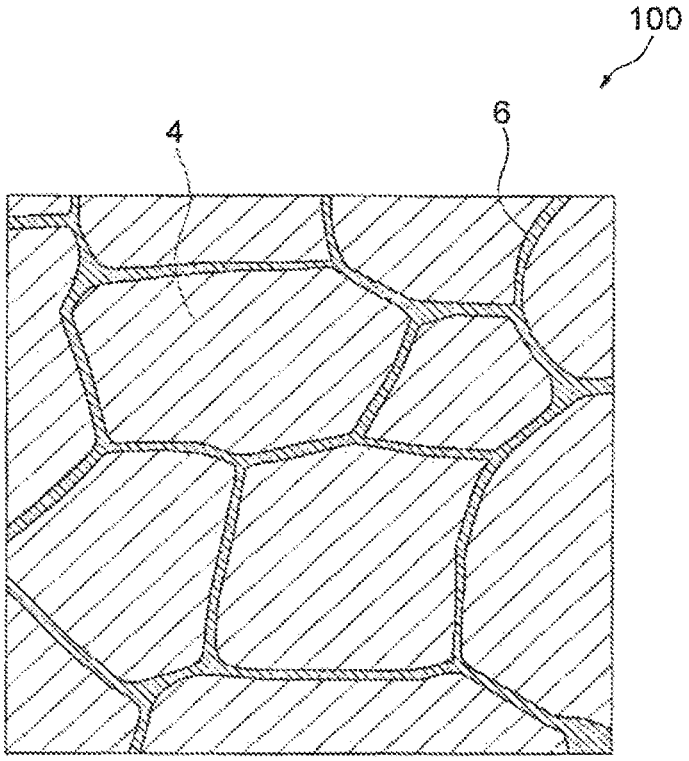
FIG. 1 is a schematic view showing a cross sectional structure of an R-T-B based sintered magnet according to an embodiment of the present invention.

The R-T-B based sintered magnet according to the first embodiment of the present invention will be described. As shown in FIG. 1, an R-T-B based sintered magnet 100 according to the present embodiment contains main phase grains 4 composed of $R_2T_{14}B$ type compound and grain boundaries 6 present among the main phase grains 4.

The main phase grains contained in the R-T-B based sintered magnet according to the present embodiment are composed of $R_2T_{14}B$ type compound having crystal structure of $R_2T_{14}B$ type tetragonal.

R represents at least one kind of rare earth elements. Rare earth elements are Sc, Y, and lanthanoid elements belonging to Group 3 in the long-periodic table. For example, lanthanoid elements include La, Ce, Pr, Nd, Sm, Eu, Gd, Tb, Dy, Ho, Er, Tm, Yb, Lu etc. Rare earth elements are divided into light rare earth elements and heavy rare earth elements. Heavy rare earth elements represent Gd, Tb, Dy, Ho, Er, Tm, Yb, and Lu, and light rare earth elements represent the other rare earth elements.

In the present embodiment, T represents one or more kinds of iron group element including Fe or Fe and Co. T may be only Fe, or may be Fe whose part is substituted with Co. When part of Fe is substituted with Co, temperature properties can be improved without deteriorating magnetic properties.

In the $R_2T_{14}B$ type compound according to the present embodiment, part of B can be substituted with carbon (C). This makes it easier to form thick two-grain boundaries during aging treatment and has an effect of easily improving coercivity.

The $R_2T_{14}B$ type compound constituting the main phase grains 4 according to the present embodiment may contain various known additive elements, specifically, may contain at least one kind of element of Ti, V, Cu, Cr, Mn, Ni, Zr, Nb, Mo, Hf, Ta, W, Al, Ga, Si, Bi, Sn, etc.

In the present embodiment, an average grain size of the main phase grains is obtained by analyzing a cross section of the R-T-B based sintered magnet using a means of image processing or so. Specifically, a cross sectional area of each main phase grain on the cross section of the R-T-B based sintered magnet is obtained by image analysis, and a diameter of a circle having this cross sectional area (circle equivalent diameter) is defined as a grain size of the main phase grain on the cross section. Furthermore, grain sizes with respect to all of the main phase grains present in a visual field subjected to analysis on the cross section are obtained, and an arithmetic average value represented by (a total value of the grain sizes of the main phase grains)/(the number of the main phase grains) is defined as an average grain size of the main phase grains in the R-T-B based sintered magnet. Incidentally, in case of an anisotropy magnet, a cross section that is parallel to axes of easy magnetization of the R-T-B based sintered magnet is used for analysis.

The main phase grains contained in the R-T-B based sintered magnet according to the present embodiment has an average grain size of 2.8 μm or less. This makes it possible to obtain a high coercivity. Furthermore, the main phase grains may have an average grain size of 2.0 μm or less. This makes it easier to obtain a further high coercivity. The average grain size of the main phase grains has no lower limit, but may be 0.8 μm or more in view of favorably maintaining magnetization property of the R-T-B based sintered magnet.

The grain boundary of the R-T-B based sintered magnet according to the present embodiment has at least an R-rich phase whose concentration of R is higher than that of the $R_2T_{14}B$ type compound constituting the main phase grains, and may contain a B-rich phase whose concentration of boron (B) is high, an R oxide phase, an R carbide phase, a Zr compound phase, or the like, in addition to the R-rich phase.

In the R-T-B based sintered magnet according to the present embodiment, R may be contained at 25 mass % or more and 36 mass % or less, or may be contained at 29.5 mass % or more and 35 mass % or less. When R is contained at 25 mass % or more, the $R_2T_{14}B$ type compound to be the main phase of the R-T-B based sintered magnet is easily sufficiently generated. This makes it hard to deposit a-Fe or so with soft magnetism and makes it easier to improve magnetic properties. When R is contained at 36 mass % or less, a ratio of the $R_2T_{14}B$ type compound contained in the R-T-B based sintered magnet is easily increased, and residual magnetic flux density is easily improved. Furthermore, R may be contained at 31 mass % or more and 34 mass % or less in view of improving coercivity. R may be contained at 31.00 mass % or more and 33.00 mass % or less. In the present embodiment, the heavy rare earth element(s) contained as R may be contained at 1.0 mass % or less in view of cost reduction and resource risk avoidance.

In the R-T-B based sintered magnet according to the present embodiment, B is contained at 0.75 mass % or more and 0.88 mass % or less. When B is contained in this range that is significantly lower than stoichiometric composition of the $R_2T_{14}B$ type compound in this manner, thick two-grain boundaries are easily formed during aging treatment, and a high coercivity is easily obtained. Furthermore, B may be contained at 0.78 mass % or more and 0.84 mass % or less. This range makes it easier to further improve coercivity.

As described above, T is one or more kinds of iron element including Fe or Fe and Co. When Co is contained as T, Co may be contained at 0.3 mass % or more and 4.0 mass % or less, or may be contained at 0.5 mass % or more and 1.5 mass % or less. When Co is contained at 4.0 mass % or less, residual magnetic flux density tends to be high, and it tends to be easier to reduce cost of the R-T-B based sintered magnet according to the present embodiment. When Co is contained at 0.3 mass % or more, corrosion resistance tends to be high. The content of Fe in the R-T-B based sintered magnet according to the present embodiment is a substantial remaining part of constituent of the R-T-B based sintered magnet.

The R-T-B based sintered magnet according to the present embodiment contains Zr at 0.65 mass % or more. With such a large amount of Zr, grain growth during sintering can be sufficiently prevented even if a finely pulverized powder has a small particle size. Zr may be contained at 0.90 mass % or more. This makes it possible to have a wide range of sintering temperature that can obtain a sufficient coercivity without causing abnormal grain growth. A high coercivity can be obtained by adjusting contents of B and C in accordance with a Zr content, and thus the Zr content may be large in view of obtaining coercivity. For example, it is conceivable that the Zr content can be large to 5.00 mass %. In view of prevention of decrease in residual magnetic flux density, however, the Zr content may be 2.50 mass % or less, or may be 2.00 mass % or less.

The R-T-B based sintered magnet according to the present embodiment may contain Ga. Ga may be contained at 0.2 mass % or more and 1.5 mass % or less, or may be contained at 0.4 mass % or more and 1.0 mass % or less. Containing Ga makes it easy to form thick two-grain boundaries during aging treatment and to obtain a high coercivity. When Ga is contained at 1.5 mass % or less, residual magnetic flux density tends to be improve. When Ga is contained at 0.2 mass % or more, coercivity tends to improve.

The R-T-B based sintered magnet according to the present embodiment may contain Cu. Cu may be contained at 0.05 mass % or more and 1.5 mass % or less, or may be contained at 0.10 mass % or more and 0.6 mass % or less. Containing Cu makes it possible to have higher coercivity, higher corrosion resistance, and improved temperature properties of the magnet to be obtained. When Cu is contained at 1.5 mass % or less, residual magnetic flux density tends to improve. When Cu is contained at 0.05 mass % or more, coercivity tends to improve.

The R-T-B based sintered magnet according to the present embodiment may contain Al. Containing Al makes it possible to have higher coercivity, higher corrosion resistance, and improved temperature properties of the magnet to be obtained. Al may be contained at 0.03 mass % or more and 0.6 mass % or less, or may be contained at 0.10 mass % or more and 0.4 mass % or less.

The R-T-B based sintered magnet according to the present embodiment may contain an additive element other than the above elements, such as Ti, V, Cr, Mn, Ni, Nb, Mo, Hf, Ta, W, Si, Bi, and Sn. The additive element other than the above elements may be contained at 2.0 mass % or less in total provided that the entire R-T-B based sintered magnet is 100 mass %.

The R-T-B based sintered magnet according to the present embodiment may contain oxygen (O) at about 0.5 mass % or less. Oxygen may be contained at 0.05 mass % or more in view of corrosion resistance, or may be 0.2 mass % or less in view of magnetic properties. Oxygen may be contained at 0.09 mass % or more and 0.17 mass % or less.

The R-T-B based sintered magnet according to the present embodiment contains a certain amount of carbon (C). In the present embodiment, a high coercivity can be obtained by adjusting a content of C in accordance with contents of B and Zr. Thus, a favorable range of the C content changes by other composition, but may be 0.1 mass % or more and 0.3 mass % or less. When the R-T-B based sintered magnet contains carbon at 0.1 mass % or more, even with a composition of a small B content, a soft magnetic compound, such as $R_2T_{17}$ type compound, can be prevented from being formed, and a high coercivity becomes easy to be obtained. When carbon is contained at 0.3 mass % or less, thick two-grain boundaries become easy to be formed, and coercivity tends to improve. C may be contained at 0.15 mass % or more and 0.30 mass % or less.

The R-T-B based sintered magnet according to the present embodiment may contain a certain amount of nitrogen (N). This certain amount changes by other parameters or so and is appropriately determined, but nitrogen may be contained at 0.01 mass % or more and 0.2 mass % or less in view of magnetic properties. Nitrogen may be contained at 0.04 mass % or more and 0.07 mass % or less.

In the R-T-B based sintered magnet according to the present embodiment, contents of each element are in the above-mentioned ranges, and contents of B, C, and Zr satisfy the following specific relation. That is, a relation of $5.0 \leq [B]+[C]-[Zr] \leq 5.6$ is satisfied, where each of [B], [C], and [Zr] represents a content of B, C, and Zr by atom %. A composition satisfying this relation makes it possible to obtain a high coercivity under the mechanism mentioned above. Furthermore, the R-T-B based sintered magnet according to the present embodiment may have a composition satisfying a relation of $5.2 \leq [B]+[C]-[Zr] \leq 5.4$. A composition satisfying this relation makes it possible to obtain a further high coercivity.

The contents of each element in the R-T-B based sintered magnet can be measured by a conventionally generally known method, such as X-ray fluorescent analysis (XRF) and inductively coupled plasma emission spectroscopic analysis (ICP-AES). A content of oxygen is measured by inert gas fusion—non-dispersive infrared absorption method, for example. A content of carbon is measured by combustion in an oxygen airflow—infrared absorption method, for example. A content of nitrogen is measured by inert gas fusion—thermal conductivity method, for example.

In the present embodiment, the contents of B, C, and Zr represented by atom % are obtained by the following procedures.

(1) First, contents of each element contained in the R-T-B based sintered magnet are analyzed by the above-mentioned analysis methods to obtain analysis values (X1) by mass % of the contents of each element. Elements to be analyzed are elements contained in the R-T-B based sintered magnet at 0.05 mass % or more, oxygen, carbon, and nitrogen.

(2) The analysis values (X1) by mass % of the contents of each element are divided by atomic weights of each element to obtain values (X3).

(3) Ratios of the values (X3) of each element with respect to a total value of the values (X3) of all of the analyzed elements represented by percentage are calculated and defined as contents (X2) of each element represented by atom %.

The R-T-B based sintered magnet according to the present embodiment is generally machined into any shape and used. The R-T-B based sintered magnet according to the present embodiment has any shape, such as rectangular parallelepiped shape, hexahedron, flat plate, and square pillar. The R-T-B based sintered magnet according to the present embodiment may have any cross sectional shape, such as C shaped cylindrical shape. The square pillar may be one whose bottom surface is rectangular or square, for example.

The R-T-B based sintered magnet according to the present embodiment includes both magnet products that are magnetized after machining the magnet and magnet products in which the magnet is not magnetized.

<Method for Manufacturing R-T-B Based Sintered Magnet>

Figure 2:
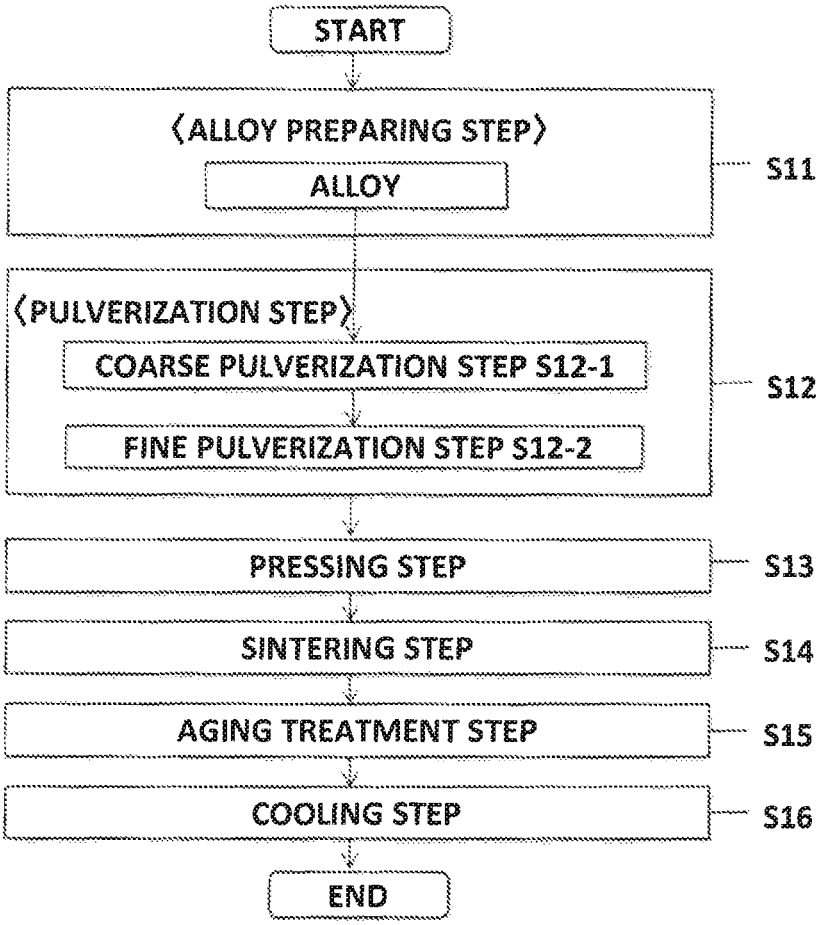
FIG. 2 is a flowchart showing a method for manufacturing an R-T-B based sintered magnet according to an embodiment of the present invention.

The figure is used to describe a method for manufacturing the R-T-B based sintered magnet according to the present embodiment having the above-mentioned structure. FIG. 2 is a flowchart showing a method for manufacturing an R-T-B based sintered magnet according to an embodiment of the present invention. As shown in FIG. 2, the method for manufacturing the R-T-B based sintered magnet according to the present embodiment has the following steps.

(a) Alloy preparing step for preparing a raw material alloy (Step S11)

(b) Pulverization step for pulverizing the raw material alloy (Step S12)

(c) Pressing step for pressing the pulverized raw material powder (Step S13)

(d) Sintering step for sintering a green compact to obtain an R-T-B based sintered magnet (Step S14)

(e) Aging treatment step for performing an aging treatment to the R-T-B based sintered magnet (Step S15)

(f) Cooling step for cooling the R-T-B based sintered magnet (Step S16)

[Alloy Preparing Step: Step S11]

A raw material alloy of the R-T-B based sintered magnet according to the present embodiment is prepared (alloy preparing step (Step S11). In the alloy preparing step, raw material metals corresponding to the composition of the R-T-B based sintered magnet according to the present embodiment are melted in a vacuum or in an inert gas atmosphere of Ar gas or so, and are subjected to casting so as to prepare a raw material alloy having a desired composition. Incidentally, a one-alloy method using a single alloy as a raw material alloy is described in the present embodiment, but a two-alloy method that prepares a raw material powder by mixing two kinds of alloys of a first alloy and a second alloy may be employed.

As the raw material metals, for example, rare earth metals, rare earth alloys, pure iron, ferroboron, alloy or compound of these, or the like can be used. The raw material metals are casted by ingot casting method, strip casting method, book molding method, centrifugal casting method, or the like. The obtained raw material alloy is subjected to a homogenization treatment as necessary in the presence of solidification segregation. The homogenization treatment of the raw material alloy is conducted in a vacuum or an inert gas atmosphere at a temperature of 700° C. to 1500° C. for 1 hour or longer. The alloy for the R-T-B based sintered magnet is melted and homogenized by this treatment.

[Pulverization Step: Step S12]

After the raw material alloy is prepared, this raw material alloy is pulverized (pulverization step: Step S12). The pulverization step includes a coarse pulverization step (Step S12-1) for pulverizing the raw material alloy until particle sizes become about hundreds μm to several mm and a fine pulverization step (Step S12-2) for finely pulverizing the raw material alloy until particle sizes become about several μm.

(Coarse Pulverization Step: Step S12-1)

The raw material alloy is coarsely pulverized until particle sizes respectively become about hundreds μm to several mm (coarse pulverization step (Step S12-1)). This obtains a coarsely pulverized powder of the raw material alloy. The coarse pulverization can be carried out by causing a self-collapsed pulverization in such manner that hydrogen is stored in the raw material alloy, and that hydrogen is released based on differences in the storage amount of hydrogen among different phases to perform dehydrogenation (hydrogen storage pulverization).

Incidentally, the coarse pulverization step (Step S12-1) may be carried out using a coarse pulverization machine, such as stamp mill, jaw crusher, and brown mill, in an inert gas atmosphere except for using the above-mentioned hydrogen storage pulverization.

The atmosphere in each step from the pulverization step (Step S12) to the sintering step (Step S15) may be a low oxygen concentration to obtain high magnetic properties. The oxygen concentration is adjusted by controlling the atmosphere in each manufacturing step or so. When the oxygen concentration in each manufacturing step is high, the rare earth elements in the raw material alloy powder are oxidized, and the oxygen amount of the R-T-B based sintered magnet is increased to cause decrease in coercivity of the R-T-B based sintered magnet. Thus, the oxygen concentration in each step may be 100 ppm or less, for example.

(Fine Pulverization Step: Step S12-2)

After the raw material alloy is coarsely pulverized, the coarsely pulverized powder of the obtained raw material alloy is finely pulverized until an average particle size becomes about several μm (fine pulverization step (Step S12-2)). This obtains a finely pulverized powder of the raw material alloy. The coarsely pulverized powder may be further finely pulverized to obtain a finely pulverized powder having particles whose average particle size is 0.1 μm or more and 2.8 μm or less, or may be further finely pulverized to obtain a finely pulverized powder having particles whose average particle size is 0.5 μm or more and 2.0 μm or less. The finely pulverized powder is configured to have such an average particle size, and thus the main phase grains after sintering can have an average grain size of 2.8 μm or less.

The fine pulverization is carried out by further pulverizing the coarsely pulverized powder using a fine pulverization machine, such as jet mil and bead mill, while conditions of pulverization time or so are appropriately adjusted. A jet mill is a dry pulverization method by releasing a high pressure inert gas (e.g. $N_2$ gas) from a narrow nozzle to generate a high speed gas flow and accelerating the coarsely pulverized powder of the raw material alloy using this high speed gas flow to cause collision among the coarsely pulverized powder of the raw material alloy and collision with a target or a container wall.

In particular, when a finely pulverized powder having a small particle size is obtained using a jet mill, the surface of the pulverized powder is very active, which easily generates reaggregation of the pulverized powder and adhesion thereof to a container wall and tends to have a low yield. Thus, when the coarsely pulverized powder of the raw material alloy is finely pulverized, a finely pulverized powder can be obtained at a high yield by adding a pulverization aid of zinc stearate, oleic amide, or the like to prevent reaggregation of the powder and adhesion thereof to a container wall. A finely pulverized powder that can be oriented easily during pressing can be obtained by adding a pulverization aid. An addition amount of a pulverization aid changes based on a particle size of the finely pulverized powder and a kind of the pulverization aid to be added, but may be about 0.1% to 1% by mass %.

There is a wet pulverization method other than a dry pulverization method like a jet mill. For example, a bead mill for performing a high speed stirring using a small diameter bead can be employed as the wet pulverization method. A multiple pulverization for conducting a dry pulverization using a jet mill and further conducting a wet pulverization using a bead mill may be carried out.

[Pressing Step: Step S13]

After the raw material alloy is finely pulverized, the finely pulverized powder is pressed into a desired shape (pressing step (Step S13)). In the pressing step (Step S13), the finely pulverized powder is filled in a press mold arranged in an electromagnet and is pressed into any shape. This operation is carried out while a magnetic field is applied to generate a predetermined orientation of the finely pulverized powder and orient crystal axis. This obtains a green compact. A green compact to be obtained is oriented in a specific direction, and thus an R-T-B based sintered magnet having anisotropy with stronger magnetism is obtained.

The finely pulverized powder may be pressed at 30 MPa to 300 MPa. The magnetic field to be applied may be at 950 kA/m to 1600 kA/m. The magnetic field to be applied is not limited to a static magnetic field, and may be a pulsed magnetic field. A static magnetic field and a pulsed magnetic field may be used at the same time as the magnetic field to be applied.

Incidentally, a wet pressing for pressing a slurry where the finely pulverized powder is dispersed in a solvent of oil or so can be applied to the pressing method other than a dry pressing for pressing the finely pulverized powder as it is as described above.

The green compact obtained by pressing the finely pulverized powder has any shape, such as parallel piped shape, flat plate shape, column shape, and ring shape, based on a desired shape of the R-T-B based sintered magnet.

[Sintering Step: Step S14]

The green compact obtained by being pressed in a magnetic field and pressed into a desired shape is sintered in a vacuum or an inert gas atmosphere to obtain the R-T-B based sintered magnet (sintering step (Step S14)). The green compact is sintered by being heated in a vacuum or in the presence of an inert gas at 900° C. to 1200° C. for 1 hour to 72 hours, for example. This causes the finely pulverized powder to have liquid phase sintering, and an R-T-B based sintered magnet (a sintered body of an R-T-B based magnet) whose main phase has an improved volume ratio is obtained. In order that the main phase grains have an average grain size of 2.8 μm or less, sintering temperature and sintering time need to be adjusted based on conditions of composition, pulverization method, difference between particle size and particle size distribution, and the like.

After the green compact is sintered, the sintered body may be rapidly cooled in view of improving manufacturing efficiency.

[Aging Treatment Step: Step S15]

After the green compact is sintered, the R-T-B based sintered magnet is subjected to an aging treatment (aging treatment step (Step S15)). After the sintering, the R-T-B based sintered magnet is subjected to an aging treatment by being held at a temperature that is lower than the temperature during the sintering. The aging treatment can be carried out by conducting a heating treatment in a vacuum or in the presence of an inert gas at 400° C. to 900° C. for 10 minutes to 10 hours, for example. If necessary, the aging treatment may be carried out multiple times at different temperatures. Such an aging treatment can improve magnetic properties of the R-T-B based sintered magnet. In the R-T-B based sintered magnet of the present embodiment, a temperature at the time of the aging treatment may be in a range of 400° C. to 600° C. Aging treatment temperature and aging treatment time are appropriately adjusted in this temperature range based on conditions of composition, difference between grain size and grain size distribution, and the like. This makes it possible to form thick two-grain boundaries and thus obtain a high coercivity.

[Cooling Step: Step S16]

After the R-T-B based sintered magnet is subjected to the aging treatment, the R-T-B based sintered magnet is rapidly cooled in an Ar gas atmosphere (cooling step (Step S16)). Then, the R-T-B based sintered magnet according to the present embodiment can be obtained. To form thick two-grain boundaries and obtain a high coercivity, a cooling rate may be 30° C./min or more.

The R-T-B based sintered magnet obtained through the above steps may be machined into a desired shape as necessary. This machining method may be a shaping process, such as cutting and grinding, a chamfering process, such as barrel polishing, or the like.

There may be a step for further diffusing heavy rare earth elements to the grain boundaries of the machined R-T-B based sintered magnet. This grain boundary diffusion can be carried out by performing a heat treatment after a compound containing heavy rare earth elements is adhered on the surface of the R-T-B based sintered magnet by application, vapor deposition, or the like, or by performing a heat treatment against the R-T-B based sintered magnet in an atmosphere containing a vapor of heavy rare earth elements. This makes it possible to further improve coercivity of the R-T-B based sintered magnet.

The obtained R-T-B based sintered magnet may be subjected to a surface treatment, such as plating, resin coating, oxidation treatment, and chemical conversion treatment. This makes it possible to further improve corrosion resistance.

The R-T-B based sintered magnet according to the present embodiment is preferably used as a magnet of, for example, a surface magnet type (Surface Permanent Magnet: SPM)

motor where a magnet is attached on the surface of a rotor, an interior magnet embedded type (Interior Permanent Magnet: IPM) motor such as inner rotor type brushless motor, and a Permanent magnet Reluctance Motor (PRM). Specifically, the R-T-B based sintered magnet according to the present embodiment is preferably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a magnet generator and the like.

Second Embodiment

The second embodiment of the present invention is directed to an R-T-B based permanent magnet manufactured by hot working. Matters of the second embodiment that are not described below are identical to those of the first embodiment. The term of "sintering" in the first embodiment shall be replaced as necessary.

<Method for Manufacturing R-T-B Based Permanent Magnet by Hot Working>

The method for manufacturing the R-T-B based permanent magnet according to the present embodiment has the following steps.

(a) Melt rapid cooling step for melting a raw material metal and rapidly cooling an obtained molten metal to obtain a ribbon (b) Pulverization step for pulverizing the ribbon to obtain a flaky raw material powder (c) Cold forming step for performing cold forming to the pulverized raw material powder (d) Preliminary heating step for preliminarily heating the cold-formed body (e) Hot forming step for performing hot forming to the preliminarily heated cold-formed body (f) Hot plastic working step for plastically deforming the hot-formed body into a predetermined shape (g) Aging treatment step for performing an aging treatment to the R-T-B based permanent magnet (a) The melt rapid cooling step is a step for melting a raw material metal and rapidly cooling an obtained molten metal to obtain a ribbon. The raw material metal is melted by any method as long as a molten metal whose component is uniform and fluidity is capable of rapid cooling solidification is obtained. The temperature of the molten metal is not limited, but may be 1000° C. or higher.

Next, the molten metal is rapidly cooled to obtain a ribbon. Specifically, the ribbon is obtained by dropping the molten metal to a rotary roll. A cooling rate of the molten metal can be adjusted by controlling a rotating speed of the rotary roll and a drop amount of the molten metal. The rotating speed is normally 10 to 30 m/sec.

(b) The pulverization step is a step for pulverizing the ribbon obtained in the melt rapid cooling step (a). There is no limit for the pulverization method. The pulverization obtains a flaky alloy powder composed of fine crystal grains of about 20 nm.

(c) The cold forming step is a step for performing cold forming to the flaky raw material powder obtained in the pulverization step (b). The cold forming is carried out by filling the raw material powder into a mold and then pressing this at a room temperature. The pressing is carried out at any pressure. The higher the pressure is, the higher the density of a cold-formed body to be obtained becomes. The density is, however, saturated if the pressure becomes a certain value or higher. Thus, no effect is demonstrated if pressure is added more than necessary. The pressing pressure is appropriately selected based on composition, particle size, and the like of the alloy powder.

There is no limit for the pressing time either. The longer the pressing time is, the higher the density of a cold-formed body to be obtained becomes. The density is, however, saturated if the pressing time becomes a certain value or longer. The density is normally saturated when the pressing time is 1 to 5 seconds.

(d) The preliminary heating step is a step for preliminarily heating the cold-formed body obtained in the cold forming step (c). The preliminary heating temperature is not limited, but is normally 500° C. or higher and 850° C. or lower. Conditions of the preliminary heating are optimized to obtain a formed body whose crystal structure is uniform and fine in the hot forming step (e) and to further improve a magnetic orientation degree in the hot plastic working step (f).

When the preliminary heating temperature is 500° or higher, grain boundary phases can be sufficiently liquefied in the hot forming step, and cracks of the formed body become hard to occur during the hot forming. The preliminary heating temperature may be 600° or higher, or may be 700° or higher. In contrast, when the preliminary heating temperature is 850° C. or lower, it becomes easier to prevent crystal grains from being coarse and to further prevent oxidation of magnetic materials. The preliminary heating temperature may be 800° C. or lower, or may be 780° C. or lower.

The preliminary heating time is a time where the cold-formed body reaches a certain temperature. The preliminary heating time is appropriately controlled to sufficiently liquefy grain boundary phases in the hot forming step, to prevent cracks of the formed body from occurring during the hot forming, and to make it easier to prevent crystal grains from being coarse. The preliminary heating time may be appropriately selected based on size of the formed body, the preliminary heating temperature, and the like. In general, the larger the size of the formed body becomes, the longer a preferable preliminary heating time becomes. Also, the lower the preliminary heating temperature becomes, the longer a preferable preliminary heating time becomes. The atmosphere during the preliminary heating is not limited, but may be an inert atmosphere or a reducing atmosphere in view of preventing oxidation of magnetic materials and decrease in magnetic properties.

(e) The hot forming step is a step for performing hot pressing to the preliminarily heated cold-formed body obtained in the preliminary heating step (d). The hot forming step can densify magnet materials.

The term of "hot forming" is a so-called hot pressing method. When the cold-formed body is hotly pressed using a hot pressing method, pores remaining in the cold-formed body disappear to achieve densification of the cold-formed body.

The hot forming using a hot pressing method is carried out by any method, such as a method for preliminarily heating the cold-formed body, inserting the preliminarily heated cold-formed body into a mold that is heated to a predetermined temperature, and pressing the cold-formed body at a predetermined pressure for a predetermined time. Hereinafter, the hot forming by this method will be described.

Conditions of the hot pressing are optimally selected based on composition, required properties, and the like. In general, when the hot pressing temperature is 750° C. or higher, grain boundary phases can be sufficiently liquefied, the formed body is sufficiently densified, and cracks of the formed body become hard to occur. In contrast, when the hot pressing temperature is 850° C. or lower, it becomes easier to prevent crystal grains from being coarse, and magnetic properties can be consequently improved.

The hot pressing is carried out at any pressure. The higher the pressure is, the higher the density of a hot-formed body to be obtained becomes. The density is, however, saturated if the pressure becomes a certain value or higher. Thus, no effect is demonstrated if pressure is added more than necessary. The hot pressing pressure is appropriately selected based on composition, particle size, and the like of the alloy powder.

The hot pressing time is not limited either. The longer the hot pressing time is, the higher the density of a hot-formed body to be obtained becomes. Crystal grains may, however, be coarse if the hot pressing time is longer more than necessary. The hot pressing time is appropriately selected based on composition, particle size, and the like of the alloy powder.

The atmosphere during the hot pressing is not limited, but may be an inert atmosphere or a reducing atmosphere in view of preventing oxidation of magnetic materials and decrease in magnetic properties.

(f) The hot plastic working step is a step for obtaining a magnet material by plastically deforming the hot-formed body obtained in the hot forming step (e) into a predetermined shape. The hot plastic working step is carried out by any method, but is particularly preferably carried out by a method of hot extrusion in view of productivity.

The working temperature is not limited. In general, when the working temperature is 750° C. or higher, grain boundary phases are sufficiently liquefied, the formed body is sufficiently densified, and cracks of the formed body become hard to occur. In contrast, when the working temperature is 850° or lower, it becomes easier to prevent crystal grains from being coarse, and magnetic properties can be consequently improved. An R-T-B based permanent magnet having desired composition and shape is obtained by carrying out a post machining as necessary after the hot plastic working step.

(g) The aging treatment step is a step for performing an aging treatment to the R-T-B based permanent magnet obtained in the hot plastic working step (f). The aging treatment is performed to the R-T-B based permanent magnet by holding the obtained the R-T-B based permanent magnet at a temperature that is lower than the temperature during the hot plastic working step after the hot plastic working, for example. The aging treatment can be carried out by performing a heating treatment in a vacuum or in the presence of an inert gas at 400° C. to 700° C. for 10 minutes to 10 hours, for example. The aging treatment may be carried out multiple times by changing the temperature as necessary. Such an aging treatment can improve magnetic properties of the R-T-B based permanent magnet. In the R-T-B based permanent magnet of the present embodiment, the temperature during the aging treatment may be in a range of 400° C. to 600° C. In this temperature range, aging treatment temperature and aging treatment time are appropriately adjusted based on conditions, such as composition and difference between grain size and grain size distribution. This makes it possible to form thick two-grain boundaries and thus obtain a high coercivity.

Hereinafter, a mechanism how an R-T-B based permanent magnet having magnetic anisotropy can be obtained by the hot forming step and the hot plastic working step will be described.

The inside of the hot-formed body consists of crystal grains and grain boundary phases. The grain boundary phases begin to liquefy when the formed body becomes high temperature during the hot forming. Then, when the heating temperature becomes higher, the crystal grains are surrounded by the liquefied grain boundary phases. Then, the crystal grains become possible to rotate. In this stage, however, the directions of axes of easy magnetization, that is, the directions of magnetization are nonuniform (equalization state). That is, the hot-formed body has normally no magnetic anisotropy.

Next, the obtained hot-formed body is subjected to the hot plastic working to plastically deformed and obtain a magnet material having a desired shape. At this time, the crystal grains are compressed in a pressurizing direction and plastically deformed, and the axes of easy magnetization are oriented in the pressurizing direction at the same time. Thus, an R-T-B based permanent magnet having magnetic anisotropy is obtained.

Incidentally, the present invention is not limited to the above embodiments, but can be variously changed within the scope thereof.

EXAMPLES

Hereinafter, the invention will be described in more detail based on the examples, but is not limited thereto.

Experimental Examples 1 to 7

First, raw material alloys were prepared. The raw materials were blended to have a composition of 25.00 Nd-7.00 Pr-0.50 Co-0.50 Ga-0.20 Al-0.20 Cu-1.10 Zr-0.79 B-remaining part Fe (values represent mass %), melted, and casted by a strip casting method. Then, flaky raw material alloys were obtained.

Next, a hydrogen pulverization treatment (coarse pulverization) for respectively storing hydrogen in these raw material alloys at room temperatures and respectively performing dehydrogenation at 400° C. for 1 hour in an Ar atmosphere was carried out.

Incidentally, in the present examples, each step from this hydrogen pulverization treatment to sintering (fine pulverization and pressing) was carried out in an inert gas atmosphere having an oxygen concentration of less than 50 ppm (the same shall apply to the following experimental examples).

Next, an oleic amide of 0.15 mass % as a pulverization aid was added to the coarsely pulverized powder subjected to the hydrogen pulverization treatment, and a fine pulverization was subsequently performed thereto using a jet mill. In the fine pulverization, a particle size of the finely pulverized powder was adjusted so that the main phase grains of the R-T-B based sintered magnet had an average grain size of 2.0 μm by adjusting a classification condition of the jet mill.

To adjust a final amount of carbon of the R-T-B based magnet, a graphite powder was added to the obtained finely pulverized powder and mixed it. The finely pulverized powders used for Experimental Examples 1 to 7 were prepared by adjusting an additive amount of the graphite powder in a range of 0 to 0.17 mass % so that the amount of carbon increased gradually.

The finely pulverized powder with which the graphite powder was mixed was filled in a press mold arranged in an electromagnet and pressed at 120 MPa while a magnetic field of 1200 kA/m was applied, whereby a green compact was obtained.

Thereafter, the obtained green compact was sintered. The green compact was sintered by being held in a vacuum at 1050° C. for 12 hours and rapidly cooled, whereby a sintered body (R-T-B based sintered magnet) was obtained. Then, the obtained sintered body was subjected to a two-step aging treatment performed at 850° C. for 1 hour and performed at 500° C. for 1 hour (both of which were in an Ar atmosphere), whereby R-T-B sintered magnets of Experimental Examples 1 to 7 were respectively obtained.

Table 1 shows results of composition analysis with respect to the R-T-B based sintered magnets of Experimental Examples 1 to 7. In the contents of each element shown in Table 1, the contents of Nd, Pr, Dy, Tb, Fe, Co, Ga, Al, Cu, and Zr were measured by a fluorescent X-ray analysis, the content of B was measured by an ICP emission analysis, the content of O was measured by an inert gas fusion—non-dispersive infrared absorption method, the content of C was measured by a combustion in oxygen airflow-infrared absorption method, and the content of N was measured by an inert gas fusion—thermal conductivity method. [B]+[C]−[Zr] was calculated by converting the contents of each element by mass % obtained by these methods into contents by atom %. Incidentally, T.RE in Tables is a summation of the contents of Nd, Pr, Dy, and Tb and represents a total content of the rare earth elements in the R-T-B based sintered magnet.

section of a sample using a scanning electron microscope and capturing this observation data into an image analysis software.

A B-H tracer was used to measure magnetic properties of the R-T-B based sintered magnets obtained in Experimental Examples 1 to 7. Residual magnetic flux density Br and coercivity HcJ were measured as the magnetic properties. These results are also shown in Table 1.

Judging from the evaluation results of the composition analysis and the average grain size of the main phase grains, the R-T-B based sintered magnets of Experimental Examples 2 to 6 correspond to Examples as they satisfy the conditions of the present invention, and the R-T-B based sintered magnets of Experimental Examples 1 and 7 correspond to Comparative Examples as they fail to satisfy the conditions of the present invention.

As shown in Table 1, it was confirmed that a high coercivity was obtained in a range of $5.0 \leq [B]+[C]-[Zr] \leq 5.6$ because coercivity of the R-T-B based sintered magnets of Experimental Examples 2 to 6 was higher than that of the R-T-B based sintered magnets of Experimental Examples 1 and 7. Furthermore, it was also confirmed that Experimental Examples 3 to 6 satisfying $5.2 \leq [B]+[C]-[Zr] \leq 5.4$ particularly had a higher coercivity.

TABLE 1

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental | mass % | 31.76 | 24.84 | 6.92 | 0.00 | 0.00 | 64.67 | 0.50 | 0.50 | 0.20 | 0.20 | 1.10 | 0.79 |
| Ex. 1 | atom % | 14.64 | 11.39 | 3.25 | 0.00 | 0.00 | 76.61 | 0.56 | 0.47 | 0.49 | 0.21 | 0.80 | 4.83 |
| Experimental | mass % | 31.77 | 24.83 | 6.94 | 0.00 | 0.00 | 64.61 | 0.50 | 0.50 | 0.20 | 0.20 | 1.10 | 0.79 |
| Ex. 2 | atom % | 14.62 | 11.37 | 3.25 | 0.00 | 0.00 | 76.38 | 0.56 | 0.47 | 0.49 | 0.21 | 0.80 | 4.82 |
| Experimental | mass % | 31.74 | 24.79 | 6.95 | 0.00 | 0.00 | 64.62 | 0.50 | 0.50 | 0.20 | 0.20 | 1.10 | 0.79 |
| Ex. 3 | atom % | 14.59 | 11.33 | 3.25 | 0.00 | 0.00 | 76.30 | 0.56 | 0.47 | 0.49 | 0.21 | 0.80 | 4.82 |
| Experimental | mass % | 31.71 | 24.80 | 6.91 | 0.00 | 0.00 | 64.60 | 0.50 | 0.50 | 0.20 | 0.20 | 1.10 | 0.79 |
| Ex. 4 | atom % | 14.54 | 11.32 | 3.23 | 0.00 | 0.00 | 76.13 | 0.56 | 0.47 | 0.49 | 0.21 | 0.79 | 4.81 |
| Experimental | mass % | 31.67 | 24.76 | 6.91 | 0.00 | 0.00 | 64.64 | 0.50 | 0.50 | 0.20 | 0.20 | 1.10 | 0.79 |
| Ex. 5 | atom % | 14.52 | 11.29 | 3.23 | 0.00 | 0.00 | 76.14 | 0.56 | 0.47 | 0.49 | 0.21 | 0.79 | 4.81 |
| Experimental | mass % | 31.65 | 24.76 | 6.89 | 0.00 | 0.00 | 64.63 | 0.50 | 0.50 | 0.20 | 0.20 | 1.10 | 0.79 |
| Ex. 6 | atom % | 14.49 | 11.28 | 3.21 | 0.00 | 0.00 | 76.03 | 0.56 | 0.47 | 0.49 | 0.21 | 0.79 | 4.80 |
| Experimental | mass % | 31.68 | 24.75 | 6.93 | 0.00 | 0.00 | 64.58 | 0.50 | 0.50 | 0.20 | 0.20 | 1.10 | 0.79 |
| Ex. 7 | atom % | 14.49 | 11.26 | 3.23 | 0.00 | 0.00 | 75.90 | 0.56 | 0.47 | 0.49 | 0.21 | 0.79 | 4.80 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental | mass % | 0.15 | 0.09 | 0.04 | 2.0 | 4.9 | 1312 | 1554 | Comp. Ex. |
| Ex. 1 | atom % | 0.83 | 0.37 | 0.19 | | | | | |
| Experimental | mass % | 0.19 | 0.10 | 0.04 | 2.0 | 5.1 | 1328 | 1729 | Ex. |
| Ex. 2 | atom % | 1.04 | 0.41 | 0.19 | | | | | |
| Experimental | mass % | 0.22 | 0.09 | 0.04 | 2.0 | 5.2 | 1342 | 1775 | Ex. |
| Ex. 3 | atom % | 1.21 | 0.37 | 0.19 | | | | | |
| Experimental | mass % | 0.24 | 0.12 | 0.04 | 2.0 | 5.3 | 1349 | 1793 | Ex. |
| Ex. 4 | atom % | 1.32 | 0.49 | 0.19 | | | | | |
| Experimental | mass % | 0.26 | 0.10 | 0.04 | 2.0 | 5.4 | 1356 | 1769 | Ex. |
| Ex. 5 | atom % | 1.42 | 0.41 | 0.19 | | | | | |
| Experimental | mass % | 0.28 | 0.11 | 0.04 | 2.0 | 5.5 | 1364 | 1710 | Ex. |
| Ex. 6 | atom % | 1.53 | 0.45 | 0.19 | | | | | |
| Experimental | mass % | 0.32 | 0.09 | 0.04 | 2.0 | 5.8 | 1382 | 1492 | Comp. Ex. |
| Ex. 7 | atom % | 1.75 | 0.37 | 0.19 | | | | | |

The R-T-B based sintered magnets obtained in Experimental Examples 1 to 7 were evaluated in terms of an average grain size of the main phase grains. The average grain size of the main phase grains was calculated by a grain size distribution obtained by observing a polished cross

Experimental Examples 8 to 13

Raw materials were blended so that R-T-B based sintered magnets having compositions shown in Table 2 were obtained, and casting of a raw material alloy, a hydrogen pulverization treatment, and a fine pulverization by a jet mill were carried out in the same manner as Experimental Example 1 with respect to each composition.

The powder finely pulverized by the jet mill was further finely pulverized using a bead mill to prepare a finely pulverized powder. The pulverization by the bead mill was carried out for a predetermined time using a zirconia bead whose diameter was 0.8 mm and using a n-paraffin as a solvent. The particle size of the finely pulverized powder was adjusted so that the main phase grains of the R-T-B based sintered magnet had an average grain size of around 1.3 μm by adjusting the number of rotations during the pulverization and the pulverization time.

The obtained finely pulverized powder was filled in slurry form in a press mold arranged in an electromagnet and pressed at 120 MPa while a magnetic field of 1200 kA/m was applying, whereby a green compact was obtained.

Thereafter, the obtained green compact was sintered. The green compact was subjected to a desolvation treatment in a vacuum at 150° C. for 2 hours, continuously sintered by being held for 12 hours after increasing the temperature to 1040° C. in the vacuum, and rapidly cooled, whereby a sintered body (R-T-B based sintered magnet) was obtained. Then, the obtained sintered body was subjected to a two-step aging treatment performed at 850° C. for 1 hour and performed at 470° C. for 1 hour (both of which were an Ar atmosphere), whereby R-T-B based sintered magnets of Experimental Examples 8 to 13 were respectively obtained.

Table 2 also shows that results of composition analysis and evaluation results of average grain size of main phase grains, both of which are obtained in the same manner as Experimental Examples 1 to 7, with respect to the R-T-B based sintered magnets of Experimental Examples 8 to 13. In the R-T-B based sintered magnet of Experimental Example 8, which contained Zr at 0.50 mass %, main phase grains that had abnormally grown to grains whose size was about 100 μm were confirmed in the sintered magnet. In the R-T-B based sintered magnet of Experimental Example 9, which contained Zr at 0.65 mass %, main phase grains that had grown to grains whose size was about 10 μm were partially confirmed and were found to tend to have an average grain size whose value was slightly larger than that of the R-T-B based sintered magnets of Experimental Examples 10 to 13.

TABLE 2

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental | mass % | 33.03 | 26.02 | 7.01 | 0.00 | 0.00 | 63.25 | 0.80 | 0.60 | 0.20 | 0.40 | 0.50 | 0.81 |
| Ex. 8 | atom % | 15.25 | 11.95 | 3.30 | 0.00 | 0.00 | 75.03 | 0.90 | 0.57 | 0.49 | 0.42 | 0.36 | 4.96 |
| Experimental | mass % | 32.99 | 25.99 | 7.00 | 0.00 | 0.00 | 63.13 | 0.80 | 0.60 | 0.20 | 0.40 | 0.65 | 0.81 |
| Ex. 9 | atom % | 15.23 | 11.94 | 3.29 | 0.00 | 0.00 | 74.90 | 0.90 | 0.57 | 0.49 | 0.42 | 0.47 | 4.96 |
| Experimental | mass % | 32.94 | 25.94 | 7.00 | 0.00 | 0.00 | 62.93 | 0.80 | 0.60 | 0.20 | 0.40 | 0.90 | 0.81 |
| Ex. 10 | atom % | 15.22 | 11.93 | 3.29 | 0.00 | 0.00 | 74.72 | 0.90 | 0.57 | 0.49 | 0.42 | 0.65 | 4.97 |
| Experimental | mass % | 32.87 | 25.91 | 6.96 | 0.00 | 0.00 | 62.72 | 0.80 | 0.60 | 0.20 | 0.40 | 1.20 | 0.81 |
| Ex. 11 | atom % | 15.21 | 11.93 | 3.28 | 0.00 | 0.00 | 74.58 | 0.90 | 0.57 | 0.49 | 0.42 | 0.87 | 4.98 |
| Experimental | mass % | 32.79 | 25.86 | 6.93 | 0.00 | 0.00 | 62.48 | 0.80 | 0.60 | 0.20 | 0.40 | 1.50 | 0.81 |
| Ex. 12 | atom % | 15.18 | 11.91 | 3.27 | 0.00 | 0.00 | 74.31 | 0.90 | 0.57 | 0.49 | 0.42 | 1.09 | 4.98 |
| Experimental | mass % | 32.75 | 25.83 | 6.92 | 0.00 | 0.00 | 62.23 | 0.80 | 0.60 | 0.20 | 0.40 | 1.80 | 0.81 |
| Ex. 13 | atom % | 15.18 | 11.91 | 3.27 | 0.00 | 0.00 | 74.12 | 0.90 | 0.57 | 0.49 | 0.42 | 1.31 | 4.96 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental | mass % | 0.20 | 0.14 | 0.07 | 1.6 | 5.7 | 1345 | 1444 | Comp. Ex. |
| Ex. 8 | atom % | 1.10 | 0.58 | 0.33 | | | | | |
| Experimental | mass % | 0.20 | 0.15 | 0.07 | 1.4 | 5.6 | 1319 | 1797 | Ex. |
| Ex. 9 | atom % | 1.10 | 0.62 | 0.33 | | | | | |
| Experimental | mass % | 0.20 | 0.15 | 0.07 | 1.3 | 5.4 | 1307 | 1902 | Ex. |
| Ex. 10 | atom % | 1.10 | 0.62 | 0.33 | | | | | |
| Experimental | mass % | 0.20 | 0.13 | 0.07 | 1.3 | 5.2 | 1294 | 1892 | Ex. |
| Ex. 11 | atom % | 1.11 | 0.54 | 0.33 | | | | | |
| Experimental | mass % | 0.20 | 0.15 | 0.07 | 1.3 | 5.0 | 1287 | 1834 | Ex. |
| Ex. 12 | atom % | 1.11 | 0.62 | 0.33 | | | | | |
| Experimental | mass % | 0.20 | 0.14 | 0.07 | 1.3 | 4.8 | 1272 | 1574 | Comp. Ex. |
| Ex. 13 | atom % | 1.11 | 0.58 | 0.33 | | | | | |

Table 2 also shows measurement results of magnetic properties of the R-T-B based sintered magnets of Experimental Examples 8 to 13. The R-T-B based sintered magnets of Experimental Examples 9 to 12 correspond to Examples as they satisfy the conditions of the present invention, and the R-T-B based sintered magnets of Experimental Examples 8 and 13 correspond to Comparative Examples as they fail to satisfy the conditions of the present invention.

The R-T-B based sintered magnets of Experimental Examples 9 to 12 had coercivity that was higher than coercivity of the R-T-B based sintered magnets of Experimental Examples 8 and 13, and it was thus confirmed that a high coercivity was obtained in a range of $5.0 \leq [B]+[C]-[Zr] \leq 5.6$. Furthermore, it was also confirmed that Experimental Examples 10 and 11 satisfying $5.2 \leq [B]+[C]-[Zr] \leq 5.4$ particularly had a higher coercivity.

Experimental Examples 14 to 20

The R-T-B based sintered magnets of Experimental Examples 14 to 20 were fabricated in the same manner as Experimental Examples 8 to 13 except that raw materials were blended so that the R-T-B based sintered magnets having compositions shown in Table 3 were obtained, and except that pulverization conditions of a bead mill were adjusted so that main phase grains of the R-T-B based sintered magnet had an average grain size of around 1.0 μm.

Table 3 also shows that composition, average grain size of main phase grains, and magnetic properties of the R-T-B based sintered magnets of Experimental Examples 14 to 20, all of which were evaluated in the same manner as Experimental Examples 8 to 13. The R-T-B based sintered magnets of Experimental Examples 15 to 19 correspond to Examples as they satisfy the conditions of the present invention, and the R-T-B based sintered magnets of Experimental Examples 14 and 20 correspond to Comparative Examples as they fail to satisfy the conditions of the present invention.

The R-T-B based sintered magnets of Experimental Examples 15 to 19 had coercivity that was higher than coercivity of the R-T-B based sintered magnets of Experimental Examples 14 and 20, and it was thus confirmed that a high coerciviy was obtained in a range of $5.0 \leq [B]+[C]-[Zr] \leq 5.6$. Furthermore, it was also confirmed that Experimental Examples 17 and 18 satisfying $5.2 \leq [B]+[C]-[Zr] \leq 5.4$ particularly had a higher coercivity.

TABLE 3

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental | mass % | 32.50 | 32.50 | 0.00 | 0.00 | 0.00 | 63.10 | 0.50 | 0.80 | 0.20 | 0.30 | 1.40 | 0.73 |
| Ex. 14 | atom % | 14.97 | 14.97 | 0.00 | 0.00 | 0.00 | 75.07 | 0.56 | 0.76 | 0.49 | 0.31 | 1.02 | 4.49 |
| Experimental | mass % | 32.51 | 32.51 | 0.00 | 0.00 | 0.00 | 63.07 | 0.50 | 0.80 | 0.20 | 0.30 | 1.40 | 0.76 |
| Ex. 15 | atom % | 14.96 | 14.96 | 0.00 | 0.00 | 0.00 | 74.95 | 0.56 | 0.76 | 0.49 | 0.31 | 1.02 | 4.67 |
| Experimental | mass % | 32.50 | 32.50 | 0.00 | 0.00 | 0.00 | 63.05 | 0.50 | 0.80 | 0.20 | 0.30 | 1.40 | 0.78 |
| Ex. 16 | atom % | 14.93 | 14.93 | 0.00 | 0.00 | 0.00 | 74.82 | 0.56 | 0.76 | 0.49 | 0.31 | 1.02 | 4.78 |
| Experimental | mass % | 32.52 | 32.52 | 0.00 | 0.00 | 0.00 | 63.02 | 0.50 | 0.80 | 0.20 | 0.30 | 1.40 | 0.81 |
| Ex. 17 | atom % | 14.93 | 14.93 | 0.00 | 0.00 | 0.00 | 74.73 | 0.56 | 0.76 | 0.49 | 0.31 | 1.02 | 4.96 |
| Experimental | mass % | 32.50 | 32.50 | 0.00 | 0.00 | 0.00 | 62.98 | 0.50 | 0.80 | 0.20 | 0.30 | 1.40 | 0.84 |
| Ex. 18 | atom % | 14.88 | 14.88 | 0.00 | 0.00 | 0.00 | 74.50 | 0.56 | 0.76 | 0.49 | 0.31 | 1.01 | 5.13 |
| Experimental | mass % | 32.49 | 32.49 | 0.00 | 0.00 | 0.00 | 62.97 | 0.50 | 0.80 | 0.20 | 0.30 | 1.40 | 0.87 |
| Ex. 19 | atom % | 14.86 | 14.86 | 0.00 | 0.00 | 0.00 | 74.39 | 0.56 | 0.76 | 0.49 | 0.31 | 1.01 | 5.31 |
| Experimental | mass % | 32.50 | 32.50 | 0.00 | 0.00 | 0.00 | 62.95 | 0.50 | 0.80 | 0.20 | 0.30 | 1.40 | 0.90 |
| Ex. 20 | atom % | 14.85 | 14.85 | 0.00 | 0.00 | 0.00 | 74.31 | 0.56 | 0.76 | 0.49 | 0.31 | 1.01 | 5.49 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental | mass % | 0.24 | 0.16 | 0.07 | 1.0 | 4.8 | 1281 | 1659 | Comp. Ex. |
| Ex. 14 | atom % | 1.33 | 0.66 | 0.33 | | | | | |
| Experimental | mass % | 0.24 | 0.15 | 0.07 | 1.0 | 5.0 | 1296 | 1856 | Ex. |
| Ex. 15 | atom % | 1.33 | 0.62 | 0.33 | | | | | |
| Experimental | mass % | 0.24 | 0.16 | 0.07 | 1.0 | 5.1 | 1302 | 1877 | Ex. |
| Ex. 16 | atom % | 1.32 | 0.66 | 0.33 | | | | | |
| Experimental | mass % | 0.24 | 0.14 | 0.07 | 1.0 | 5.3 | 1311 | 1927 | Ex. |
| Ex. 17 | atom % | 1.32 | 0.58 | 0.33 | | | | | |
| Experimental | mass % | 0.24 | 0.17 | 0.07 | 1.0 | 5.4 | 1321 | 1901 | Ex. |
| Ex. 18 | atom % | 1.32 | 0.70 | 0.33 | | | | | |
| Experimental | mass % | 0.24 | 0.16 | 0.07 | 1.0 | 5.6 | 1330 | 1808 | Ex. |
| Ex. 19 | atom % | 1.32 | 0.66 | 0.33 | | | | | |
| Experimental | mass % | 0.24 | 0.14 | 0.07 | 1.0 | 5.8 | 1374 | 1395 | Comp. Ex. |
| Ex. 20 | atom % | 1.32 | 0.58 | 0.33 | | | | | |

Experimental Examples 21 to 24

Experiments for confirming variation of coercivity with respect to average grain size of main phase grains were carried out. Casting of raw material alloy, a hydrogen pulverization treatment, and a fine pulverization by a jet mill were carried out in the same manner as Experimental Examples 8 to 13, and a fine pulverization using a bead mill was subsequently carried out to fabricate a finely pulverized powder. R-T-B based sintered magnets of Experimental Examples 22 to 24 having different average grain sizes of the main phase grains were fabricated by changing pulverization conditions of the bead mill and fabricating finely pulverized powders having different particle sizes. Furthermore, an example that was not subjected to the fine pulverization by the bead mill but was subjected to only the fine pulverization by the jet mill was also fabricated (Experimental Example 21). Experimental Examples 21 to 24 are examples aimed for comparison among equivalent compositions. The amount of carbon finally contained in the R-T-B based sintered magnet varies depending on a particle size of the finely pulverized powder pulverized by the bead mill, and thus Experimental Examples 23 and 24 were adjusted so that $[B]+[C]-[Zr]=5.3$ was obtained by increasing the amount of Zr in the raw material blending. Incidentally, in the present experiments, the particle size of the finely pulverized powder could not be reduced to a certain level or less even though the pulverization conditions of the bead mill were changed, and thus an R-T-B based sintered magnet whose average grain size of main phase grains was less than 0.8 μm could not be fabricated.

Table 4 shows that composition, average grain size of main phase grains, and magnetic properties of the R-T-B based sintered magnets of Experimental Examples 21 to 24, all of which were evaluated in the same manner as Experimental Examples 8 to 13. The R-T-B based sintered magnets of Experimental Examples 22 to 24 correspond to Examples as they satisfy the conditions of the present invention, and the R-T-B based sintered magnet of Experimental Example 21 correspond to Comparative Example as it fails to satisfy the conditions of the present invention.

In the comparison under the composition conditions for $[B]+[C]-[Zr]=5.3$, it was confirmed that the R-T-B based sintered magnets of Experimental Examples 22 to 24, whose average grain size of the main phase grains was 2.8 μm or less, had a higher coercivity than coercivity of Experimental Example 21, whose average grain size of the main phase grains was 3.6 μm.

TABLE 4

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental | mass % | 32.25 | 32.25 | 0.00 | 0.00 | 0.00 | 63.66 | 0.80 | 0.70 | 0.30 | 0.25 | 0.90 | 0.84 |
| Ex. 21 | atom % | 14.79 | 14.79 | 0.00 | 0.00 | 0.00 | 75.39 | 0.90 | 0.66 | 0.74 | 0.26 | 0.65 | 5.14 |
| Experimental | mass % | 32.23 | 32.23 | 0.00 | 0.00 | 0.00 | 63.66 | 0.80 | 0.70 | 0.30 | 0.25 | 0.90 | 0.84 |
| Ex. 22 | atom % | 14.77 | 14.77 | 0.00 | 0.00 | 0.00 | 75.33 | 0.90 | 0.66 | 0.73 | 0.26 | 0.65 | 5.13 |
| Experimental | mass % | 32.20 | 32.20 | 0.00 | 0.00 | 0.00 | 63.48 | 0.80 | 0.70 | 0.30 | 0.25 | 1.05 | 0.84 |
| Ex. 23 | atom % | 14.73 | 14.73 | 0.00 | 0.00 | 0.00 | 75.00 | 0.90 | 0.66 | 0.73 | 0.26 | 0.76 | 5.13 |
| Experimental | mass % | 32.16 | 32.16 | 0.00 | 0.00 | 0.00 | 62.43 | 0.80 | 0.70 | 0.30 | 0.25 | 2.00 | 0.84 |
| Ex. 24 | atom % | 14.68 | 14.68 | 0.00 | 0.00 | 0.00 | 73.63 | 0.89 | 0.66 | 0.73 | 0.26 | 1.44 | 5.12 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental | mass % | 0.15 | 0.10 | 0.05 | 3.6 | 5.3 | 1384 | 1541 | Comp. Ex. |
| Ex. 21 | atom % | 0.83 | 0.41 | 0.24 | | | | | |
| Experimental | mass % | 0.15 | 0.12 | 0.05 | 2.8 | 5.3 | 1368 | 1724 | Ex. |
| Ex. 22 | atom % | 0.83 | 0.50 | 0.24 | | | | | |
| Experimental | mass % | 0.17 | 0.16 | 0.05 | 2.0 | 5.3 | 1334 | 1812 | Ex. |
| Ex. 23 | atom % | 0.93 | 0.66 | 0.24 | | | | | |
| Experimental | mass % | 0.30 | 0.17 | 0.05 | 0.8 | 5.3 | 1292 | 1920 | Ex. |
| Ex. 24 | atom % | 1.65 | 0.70 | 0.24 | | | | | |

Experimental Examples 25 to 30

R-T-B based sintered magnets of Experimental Examples 25 to 30 were fabricated in the same manner as Experimental Examples 8 to 13 except that raw materials were blended so that the R-T-B based sintered magnets having compositions shown in Table 5 were obtained, and except that pulverization conditions of a bead mill were adjusted so that main phase grains of the R-T-B based sintered magnet had an average grain size of around 1.5 μm.

Table 5 shows that composition, average grain size of main phase grains, and magnetic properties of the R-T-B based sintered magnets of Experimental Examples 25 to 30, all of which were evaluated in the same manner as Experimental Examples 8 to 13. The R-T-B based sintered magnets of Experimental Examples 26 and 29 correspond to Examples as they satisfy the conditions of the present invention, and the R-T-B based sintered magnets of Experimental Examples 25, 27, 28, and 30 respectively correspond to Comparative Examples as they fail to satisfy the conditions of the present invention.

It was confirmed that a high coercivity can be obtained in the range of $5.0 \leq [B]+[C]-[Zr] \leq 5.6$ even in case of a composition where Dy and Tb are slightly contained like the present experimental examples.

TABLE 5

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental | mass % | 31.00 | 24.00 | 6.50 | 0.50 | 0.00 | 64.43 | 1.00 | 0.40 | 0.40 | 0.60 | 1.05 | 0.75 |
| Ex. 25 | atom % | 14.14 | 10.91 | 3.03 | 0.20 | 0.00 | 75.66 | 1.11 | 0.38 | 0.97 | 0.62 | 0.75 | 4.55 |
| Experimental | mass % | 31.00 | 24.00 | 6.50 | 0.50 | 0.00 | 64.37 | 1.00 | 0.40 | 0.40 | 0.60 | 1.05 | 0.83 |
| Ex. 26 | atom % | 14.09 | 10.88 | 3.02 | 0.20 | 0.00 | 75.34 | 1.11 | 0.38 | 0.97 | 0.62 | 0.75 | 5.02 |
| Experimental | mass % | 31.00 | 24.00 | 6.50 | 0.50 | 0.00 | 64.28 | 1.00 | 0.40 | 0.40 | 0.60 | 1.05 | 0.90 |
| Ex. 27 | atom % | 14.04 | 10.83 | 3.00 | 0.20 | 0.00 | 74.94 | 1.10 | 0.37 | 0.97 | 0.61 | 0.75 | 5.42 |
| Experimental | mass % | 31.21 | 31.01 | 0.00 | 0.00 | 0.20 | 63.90 | 1.50 | 1.00 | 0.10 | 0.10 | 1.05 | 0.75 |
| Ex. 28 | atom % | 14.27 | 14.19 | 0.00 | 0.00 | 0.08 | 75.51 | 1.68 | 0.95 | 0.24 | 0.10 | 0.76 | 4.58 |
| Experimental | mass % | 31.19 | 30.99 | 0.00 | 0.00 | 0.20 | 63.85 | 1.50 | 1.00 | 0.10 | 0.10 | 1.05 | 0.83 |
| Ex. 29 | atom % | 14.21 | 14.13 | 0.00 | 0.00 | 0.08 | 75.17 | 1.67 | 0.94 | 0.24 | 0.10 | 0.76 | 5.05 |
| Experimental | mass % | 31.22 | 31.02 | 0.00 | 0.00 | 0.20 | 63.74 | 1.50 | 1.00 | 0.10 | 0.10 | 1.05 | 0.90 |
| Ex. 30 | atom % | 14.17 | 14.09 | 0.00 | 0.00 | 0.08 | 74.78 | 1.67 | 0.94 | 0.24 | 0.10 | 0.75 | 5.45 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental | mass % | 0.19 | 0.12 | 0.06 | 1.5 | 4.8 | 1323 | 1572 | Comp. Ex. |
| Ex. 25 | atom % | 1.04 | 0.49 | 0.28 | | | | | |
| Experimental | mass % | 0.19 | 0.10 | 0.06 | 1.5 | 5.3 | 1354 | 1812 | Ex. |
| Ex. 26 | atom % | 1.03 | 0.41 | 0.28 | | | | | |
| Experimental | mass % | 0.19 | 0.12 | 0.06 | 1.5 | 5.7 | 1386 | 1482 | Comp. Ex. |
| Ex. 27 | atom % | 1.03 | 0.49 | 0.28 | | | | | |
| Experimental | mass % | 0.19 | 0.14 | 0.06 | 1.5 | 4.9 | 1352 | 1542 | Comp. Ex. |
| Ex. 28 | atom % | 1.04 | 0.58 | 0.28 | | | | | |
| Experimental | mass % | 0.19 | 0.13 | 0.06 | 1.5 | 5.3 | 1385 | 1798 | Ex. |
| Ex. 29 | atom % | 1.04 | 0.53 | 0.28 | | | | | |

TABLE 5-continued

| | | | | | | | | | |
|---|---|---|---|---|---|---|---|---|---|
| Experimental Ex. 30 | mass % | 0.19 | 0.14 | 0.06 | 1.5 | 5.7 | 1414 | 1464 | Comp. Ex. |
| | atom % | 1.04 | 0.57 | 0.28 | | | | | |

Experimental Examples 31 to 36

R-T-B based sintered magnets of Experimental Examples 31 to 36 were fabricated in the same manner as Experimental Examples 8 to 13 except that raw materials were blended so that the R-T-B based sintered magnets having compositions shown in Table 6 were obtained, and except that pulverization conditions of a bead mill were adjusted. In Experimental Examples 31 to 33, pulverization conditions of a bead mill were adjusted so that main phase grains of the R-T-B based sintered magnet had an average grain size of around 0.8 μm. In Experimental Examples 34 to 36, pulverization conditions of a bead mill were adjusted so that main phase grains of the R-T-B based sintered magnet had an average grain size of around 1.0 μm.

Table 6 shows that composition, average grain size of main phase grains, and magnetic properties of the R-T-B based sintered magnets of Experimental Examples 31 to 36, all of which were evaluated in the same manner as Experimental Examples 8 to 13. The R-T-B based sintered magnets of Experimental Examples 32 and 35 correspond to Examples as they satisfy the conditions of the present invention, and the R-T-B based sintered magnets of Experimental Examples 31, 33, 34, and 36 respectively correspond to Comparative Examples as they fail to satisfy the conditions of the present invention.

Also in the present experimental examples, it was confirmed that a high coercivity was obtained in the range of $5.0 \leq [B]+[C]-[Zr] \leq 5.6$.

NUMERICAL REFERENCES

4 main phase grain
6 grain boundary
100 R-T-B based sintered magnet

The invention claimed is:

1. An R-T-B based permanent magnet comprising main phase grains composed of an $R_2T_{14}B$ compound, where R is a rare earth element, T is at least one iron group element essentially comprising Fe or Fe and Co, and B is boron, an average grain size of the main phase grains is in a range of 1.3 μm or more and 2.0 μm or less, the R-T-B based permanent magnet contains at least C and Zr, and optionally contains Ga, Cu, Al, O, N, Ti, V, Cr, Mn, Ni, Nb, Mo, Hf, Ta, W, Si, Bi, and Sn in addition to R, T, and B, and the R-T-B based permanent magnet does not include a heavy rare earth element, wherein R is contained at 25 mass % or more and 36 mass % or less, B is contained at 0.75 mass % or more and 0.88 mass % or less, C is contained at 0.1 mass % or more and 0.3 mass % or less, Zr is contained at 0.65 mass % or more and 5.00 mass % or less, Ga is contained at 1.5 mass % or less, Cu is contained at 1.5 mass % or less, Al is contained at 0.6 mass % or less, O is contained at 0.5 mass % or less,

TABLE 6

| | | Magnet composition | | | | | | | | | | | |
|---|---|---|---|---|---|---|---|---|---|---|---|---|---|
| | | T.RE | Nd | Pr | Dy | Tb | Fe | Co | Ga | Al | Cu | Zr | B |
| Experimental Ex. 31 | mass % | 32.98 | 26.01 | 6.97 | 0.00 | 0.00 | 60.94 | 1.20 | 0.50 | 0.30 | 0.20 | 2.50 | 0.83 |
| | atom % | 15.24 | 11.96 | 3.28 | 0.00 | 0.00 | 72.36 | 1.35 | 0.48 | 0.74 | 0.21 | 1.82 | 5.09 |
| Experimental Ex. 32 | mass % | 33.00 | 25.99 | 7.01 | 0.00 | 0.00 | 60.88 | 1.20 | 0.50 | 0.30 | 0.20 | 2.50 | 0.88 |
| | atom % | 15.22 | 11.92 | 3.29 | 0.00 | 0.00 | 72.14 | 1.35 | 0.47 | 0.74 | 0.21 | 1.81 | 5.39 |
| Experimental Ex. 33 | mass % | 32.98 | 26.00 | 6.98 | 0.00 | 0.00 | 60.81 | 1.20 | 0.50 | 0.30 | 0.20 | 2.50 | 0.96 |
| | atom % | 15.14 | 11.88 | 3.26 | 0.00 | 0.00 | 71.74 | 1.34 | 0.47 | 0.73 | 0.21 | 1.81 | 5.85 |
| Experimental Ex. 34 | mass % | 31.99 | 31.99 | 0.00 | 0.00 | 0.00 | 64.27 | 0.70 | 0.80 | 0.10 | 0.10 | 0.90 | 0.69 |
| | atom % | 14.70 | 14.70 | 0.00 | 0.00 | 0.00 | 76.29 | 0.79 | 0.76 | 0.25 | 0.10 | 0.65 | 4.23 |
| Experimental Ex. 35 | mass % | 32.00 | 32.00 | 0.00 | 0.00 | 0.00 | 64.19 | 0.70 | 0.80 | 0.10 | 0.10 | 0.90 | 0.75 |
| | atom % | 14.66 | 14.66 | 0.00 | 0.00 | 0.00 | 75.95 | 0.78 | 0.76 | 0.24 | 0.10 | 0.65 | 4.58 |
| Experimental Ex. 36 | mass % | 31.97 | 31.97 | 0.00 | 0.00 | 0.00 | 64.14 | 0.70 | 0.80 | 0.10 | 0.10 | 0.90 | 0.83 |
| | atom % | 14.58 | 14.58 | 0.00 | 0.00 | 0.00 | 75.57 | 0.78 | 0.76 | 0.24 | 0.10 | 0.65 | 5.05 |

| | | Magnet composition | | | Average grain size | | Br | HcJ | |
|---|---|---|---|---|---|---|---|---|---|
| | | C | O | N | (μm) | [B] + [C] − [Zr] | (mT) | (kA/m) | |
| Experimental Ex. 31 | mass % | 0.30 | 0.19 | 0.06 | 0.8 | 4.9 | 1252 | 1720 | Comp. Ex. |
| | atom % | 1.66 | 0.79 | 0.28 | | | | | |
| Experimental Ex. 32 | mass % | 0.30 | 0.18 | 0.06 | 0.8 | 5.2 | 1275 | 1945 | Ex. |
| | atom % | 1.65 | 0.74 | 0.28 | | | | | |
| Experimental Ex. 33 | mass % | 0.30 | 0.19 | 0.06 | 0.8 | 5.7 | 1329 | 1513 | Comp. Ex. |
| | atom % | 1.65 | 0.78 | 0.28 | | | | | |
| Experimental Ex. 34 | mass % | 0.24 | 0.15 | 0.06 | 1.0 | 4.9 | 1296 | 1645 | Comp. Ex. |
| | atom % | 1.32 | 0.62 | 0.28 | | | | | |
| Experimental Ex. 35 | mass % | 0.24 | 0.16 | 0.06 | 1.0 | 5.3 | 1322 | 1887 | Ex. |
| | atom % | 1.32 | 0.66 | 0.28 | | | | | |
| Experimental Ex. 36 | mass % | 0.24 | 0.16 | 0.06 | 1.0 | 5.7 | 1354 | 1562 | Comp. Ex. |
| | atom % | 1.31 | 0.66 | 0.28 | | | | | |

N is contained at 0.2 mass % or less, a total content of Ti, V, Cr, Mn, Ni, Nb, Mo, Hf, Ta, W, Si, Bi, and Sn is 2.0 mass % or less, T is contained as a balance, a formula (1) of $5.2 \leq [B]+[C]-[Zr] \leq 5.4$ is satisfied, where [B] is a B content represented by atom %, [C] is a C content represented by atom %, and [Zr] is a Zr content represented by atom %, and a coercivity of the R-T-B based permanent magnet is 1812 kA/m or more and 1902 kA/m or less.

2. The R-T-B based permanent magnet according to claim 1, wherein Co is contained at 0.3 mass % or more and 4.0 mass % or less.

3. The R-T-B based permanent magnet according to claim 1, wherein Ga is contained at 0.2 mass % or more and 1.5 mass % or less.

4. The R-T-B based permanent magnet according to claim 1, wherein Cu is contained at 0.05 mass % or more and 1.5 mass % or less.

5. The R-T-B based permanent magnet according to claim 1, wherein Al is contained at 0.03 mass % or more and 0.6 mass % or less.

6. The R-T-B based permanent magnet according to claim 1, wherein O is contained at 0.05 mass % or more and 0.5 mass % or less.

7. The R-T-B based permanent magnet according to claim 1, wherein N is contained at 0.01 mass % or more and 0.2 mass % or less.

8. The R-T-B based permanent magnet according to claim 1, wherein B is contained at 0.78 mass % or more and 0.84 mass % or less.

9. The R-T-B based permanent magnet according to claim 1, wherein Zr is contained at 0.65 mass % or more and 2.50 mass % or less.

10. The R-T-B based permanent magnet according to claim 1, wherein Zr is contained at 0.65 mass % or more and 1.20 mass % or less.

11. The R-T-B based permanent magnet according to claim 1, wherein a residual magnetic flux density of the R-T-B based permanent magnet is 1294 mT or more and 1334 mT or less.

* * * * *